US005667642A

United States Patent [19]

Luthi

[11] Patent Number: 5,667,642

[45] Date of Patent: Sep. 16, 1997

[54] PULP SLURRY-HANDLING PRESS ROLL AND TWIN AND SINGLE ROLL SLURRY HANDLING PRESSES

[75] Inventor: Oscar Luthi, Nashua, N.H.

[73] Assignee: Beloit Technologies, Inc., Wilmington, Del.

[21] Appl. No.: 598,410

[22] Filed: Feb. 8, 1996

Related U.S. Application Data

[63] Continuation of Ser. No. 293,872, Aug. 22, 1994, abandoned.

[51] Int. Cl.[6] ..... D21F 2/60; B30B 9/24; B01D 33/06

[52] U.S. Cl. ..... 162/358.1; 162/357; 100/121; 210/404

[58] Field of Search ..... 162/357, 358.1, 162/358.5, 300, 301, 302, 289, 290; 100/121; 210/402–404

[56] References Cited

U.S. PATENT DOCUMENTS

| | | | |
|---|---|---|---|
| 1,782,215 | 11/1930 | Sheperd | 162/302 |
| 3,091,563 | 5/1963 | Meyer | 162/357 |
| 3,349,693 | 10/1967 | Mitchell, Jr. | 100/90 |
| 3,527,668 | 9/1970 | Küsters et al. | 162/272 |
| 3,680,708 | 8/1972 | Luthi | 210/404 |
| 3,821,076 | 6/1974 | Stenberg et al. | 162/301 |
| 3,980,518 | 9/1976 | Ljung et al. | 162/302 |
| 4,085,003 | 4/1978 | Luthi | 162/259 |
| 4,366,025 | 12/1982 | Gordon, Jr. et al. | 162/358.1 |
| 4,559,106 | 12/1985 | Skyttä | 210/232 |
| 4,906,364 | 3/1990 | Luthi et al. | 210/232 |
| 5,046,338 | 9/1991 | Luthi | 68/43 |
| 5,281,343 | 1/1994 | Lewis et al. | 210/784 |

FOREIGN PATENT DOCUMENTS

| | | |
|---|---|---|
| 0 136 787 | 10/1985 | European Pat. Off. . |
| 91 10 093 | 10/1991 | Germany . |
| 2 123 862 | 2/1984 | United Kingdom . |

*Primary Examiner*—Donald E. Czaja
*Assistant Examiner*—Calvin Padgett
*Attorney, Agent, or Firm*—Dirk J. Veneman; Raymond W. Campbell

[57] ABSTRACT

A drum having a longitudinal axis, and an outer periphery, has a multiplicity of longitudinal, drainage grooves formed therein, and a cylindrical sheath encloses the drum, the sheath having a multiplicity of holes formed therein. The drum is imperforate. A pair of the drums is employed in a twin-roll press as press rolls, and one thereof is used in a single roll press with a compaction baffle. In one embodiment, the press roll has its grooves formed in a herringbone pattern, the same pointed in the direction of rotation, to enhance drainage. In another embodiment, the longitudinal drainage grooves have increasing depth, toward a mid-length of the press roll where they open into inner-drum drainage conduits which discharge the filtrate adjacent the rotary axis of the press roll.

11 Claims, 5 Drawing Sheets

PULP SLURRY-HANDLING PRESS ROLL AND TWIN AND SINGLE ROLL SLURRY HANDLING PRESSES

This application is a continuation of earlier filed application No. 08/293,872, now abandoned.

BACKGROUND OF THE INVENTION

This invention pertains to pulp slurry-handling press rolls, and to slurry-handling roll presses, employing such press rolls, and in particular to a novel press roll for use in such roll presses as well as to twin roll and single roll slurry-handling presses incorporating the novel press roll.

It is already known, in the prior art, to form press rolls with liquid drainage grooves for quick and efficient removal of filtrate from the pulp mat. The following factors are affected by groove design: (a) the roll speed, as it affects the press capacity, (b) rewetting of the mat following the nip (in twin roll presses), as this determines the discharge consistency, (c) maximum roll length, and (d) roll cost. Commonly, the grooves are circumferentially formed in the roll, and a cylindrical sheath having a multiplicity of minute holes encloses the roll. Each of the grooves has a multiplicity of drilled holes formed therein for admitting filtrate therethrough for drainage into the interior of the roll. The roll comprises a cylindrical drum supported on a number of axially extended ribs which are welded to a heavy shaft. The ribs have cut outs formed therein to conduct the filtrate therethrough to flow channels, within the drum, which are defined by adjoining ribs. Such prior art press rolls are very expensive to manufacture and, functionally, they cause an unwarranted rewetting of the pulp mat.

SUMMARY OF THE INVENTION

It is a purpose of this invention to set forth a novel pulp slurry-handling press roll, and twin and single roll, slurry-handling presses incorporating such a novel press roll, which is inexpensive to manufacture, and greatly diminishes the rewetting of the pulp mat.

Particularly, it is a purpose of this invention to set forth a pulp slurry-handling press roll comprising a drum having (a) a longitudinal axis, and (b) an outer periphery; and wherein said drum further has a multiplicity of longitudinal grooves formed therein about said periphery thereof; and means overlying said grooves for filtering liquid therethrough.

It is a purpose of this invention, as well, to disclose a twin roll, slurry-handling press comprising a housing; and a pair of coacting press rolls journalled in said housing; wherein said housing has means for admitting pulp slurry to said press rolls; and further including doctor means, for extracting a pulp mat from said rolls; and wherein each of said rolls comprises a drum having (a) a longitudinal axis, and (b) an outer periphery, (c) a multiplicity of longitudinal grooves formed therein about said periphery, and (d) means overlying said grooves for filtering liquid therethrough.

Another purpose of this invention is to set forth a single roll, slurry-handling press comprising a housing; and a press roll journalled in said housing; wherein said housing has (a) means for admitting pulp slurry to said roll, and (b) doctor means for extracting a pulp mat from said roll; means for compacting pulp on said roll circumjacent said roll; and wherein said roll comprises a drum having (a) a longitudinal axis, (b) an outer periphery, (c) a multiplicity of longitudinal grooves formed therein about said periphery, and (d) means overlying said grooves for filtering liquid therethrough.

The aforesaid, and further purposes and features of the invention will become apparent by reference to the following description, taken in conjunction with the accompanying figures.

DESCRIPTION OF THE PREFERRED EMBODIMENTS

Figure 1:
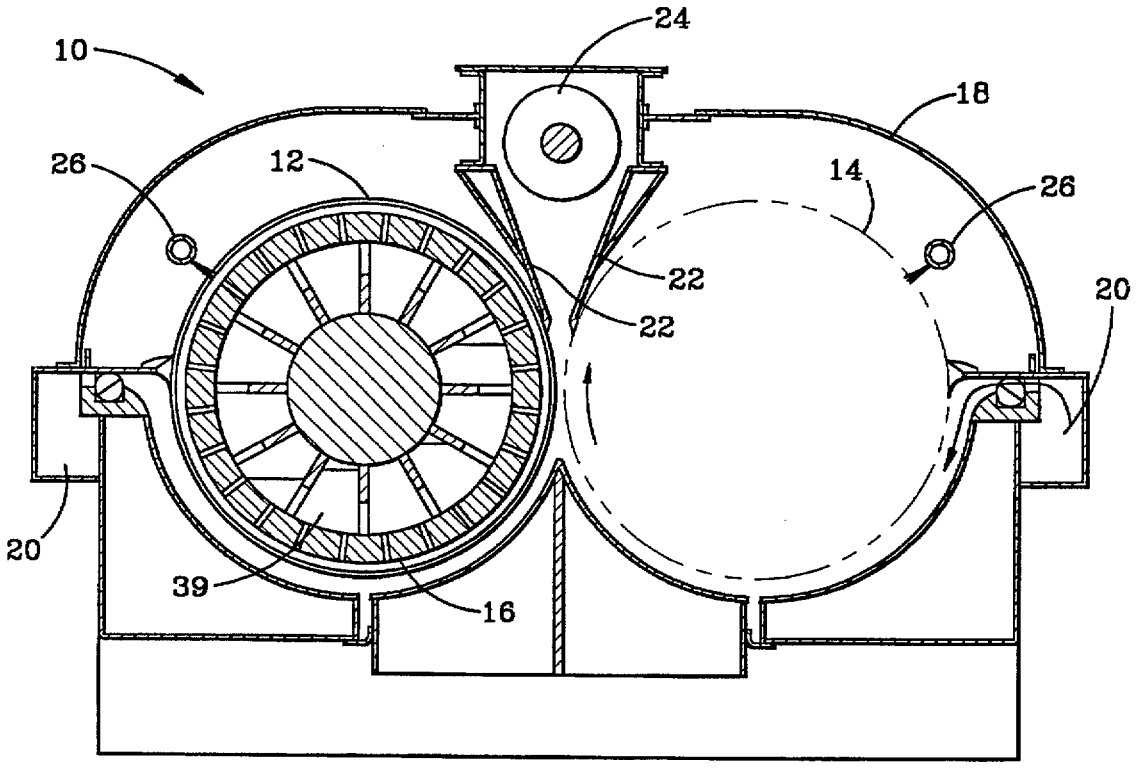
FIG. 1 (PRIOR ART)
FIG. 1 is a cross-sectional view of a prior art, twin roll press in which the press rolls have circumferential, drainage grooves.

FIG. 1 depicts a prior art, twin roll press 10 in which the press rolls 12 and 14 have circumferential grooves 16 (only one of which is indicated, in roll 12). Roll 12 is shown in cross-section, and roll 14 only as a circular component; it is robe understood, however, that rolls 12 and 14 are identical. The rolls 12 and 14 are rotatably journalled in a housing 18. At each side of the housing are pulp slurry inlet boxes 20. Also, mounted within the housing 18 are doctors 22 for extracting a pulp mat from the rolls 12 and 14 and guiding the mat to a conveyor 24. Cleaning shower heads 26 are disposed, in the housing 18, at a location just prior (with respect to the rotary direction of the rolls) to the inlet boxes 20.

Figure 2:
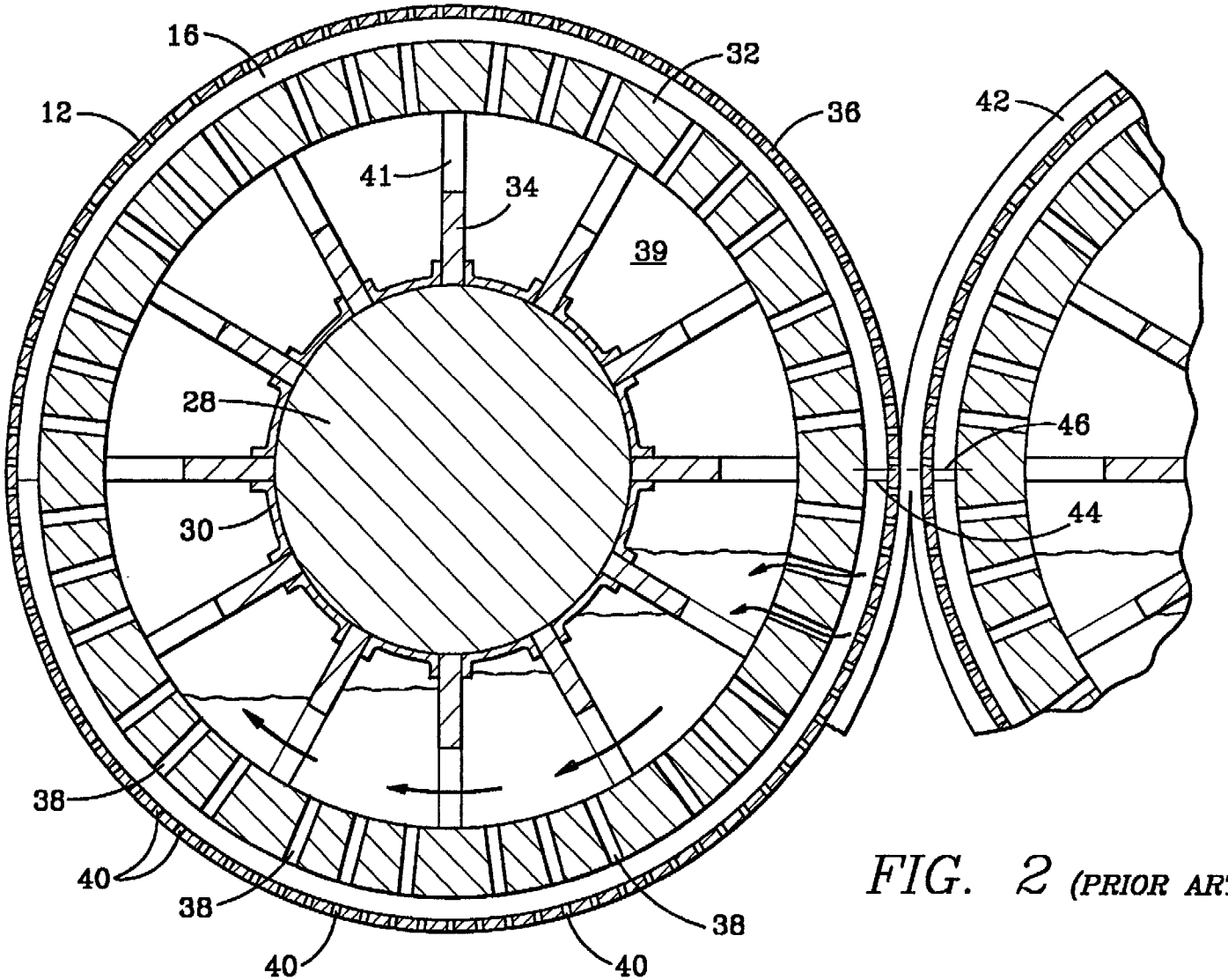
FIG. 2 (PRIOR ART)
FIG. 2 is an enlarged, cross-sectional view of one of the press rolls of FIG. 1.

In greater, enlarged detail, one of the identical rolls 12, of FIG. 1, is illustrated in FIG. 2. The same has a steel shaft 28 with stainless steel cladding 30. A stainless steel shell or drum 32 is carried on the shaft 28 by means of a dozen (in this example) support ribs 34. Enclosing the drum 32 is a cylinder or cylindrical sheath 36. The drum 32 has a multiplicity of drainage holes 38 formed therein which open internally of the drum 32 and externally thereof onto the circumferential grooves 16. The sheath 36 comprises a filter, the same having a great multiplicity of minute holes 40 formed therein. Each rib 34, in cooperation with others thereof to each side, defines flow channels 39, and the ribs have cut-outs 41 formed therein to permit liquid to conduct from one flow channel 39 to another thereof.

The filtrate levels are indicated in FIG. 2. Clearly, to prevent any unwarranted rewetting of the mat 42, it is important for the liquid level 44 in the drainage grooves 16 to be below the centerline 46 of the nip. If the liquid level is above the centerline 44, the post-nip, expanding mat 42 will create a small vacuum and can, therefore, cause the filtrate to flow back out through the drainage holes 38 and filter holes 40 and rewet the cake or mat 42. Even a small amount of rewetting is detrimental for high consistency discharge.

At higher speeds of rotation, the differential of the liquid level 44 gets greater. Too, the longitudinal ribs 34 produce a pumping effect which tends to raise the level 44 up toward the centerline 46 of the nip. Longer machines and higher hydraulic capacities require more head for the filtrate to flow out of the ends of the rolls 12 and 14. All these factors greatly increase the likelihood of unwanted rewetting of the mat 42. Equally significant, the known design of the rolls 12 and 14, as depicted, is also very expensive to manufacture, requiring as they do the heavy stainless steel sheel or drum 32, the stainless steel ribs 34, the stainless steel cladding 30, drilling of the drainage holes 38 and machining of the circumferential drainage grooves 16.

Figure 3:
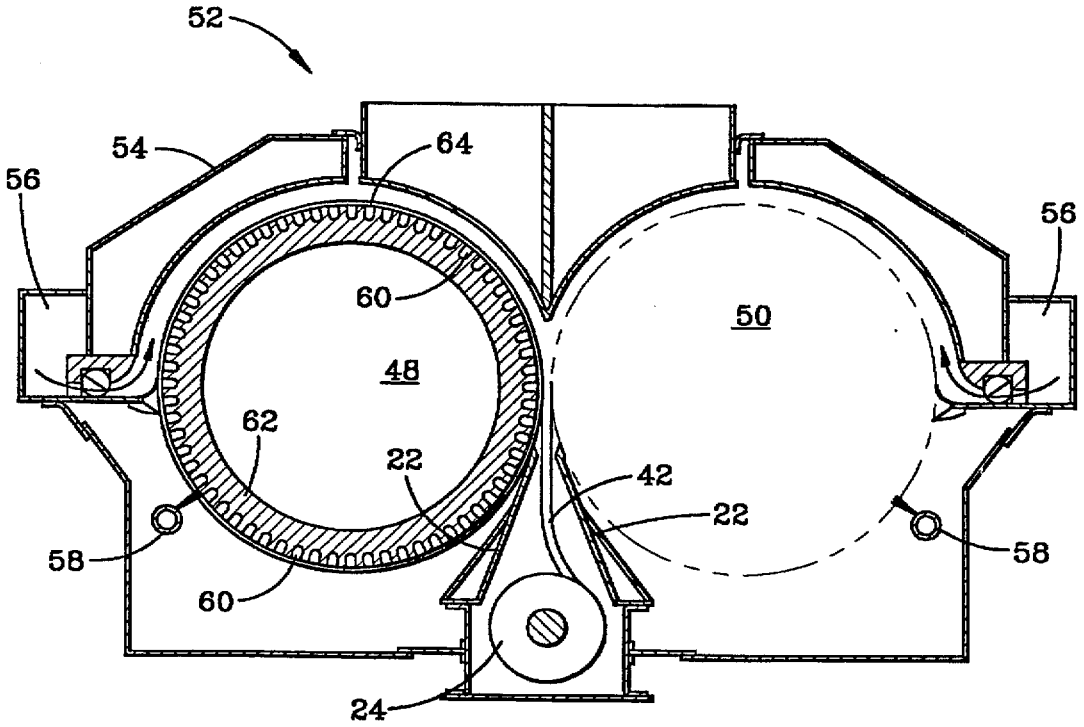
FIG. 3 is a cross-sectional view of a twin roll press in which the press rolls, according to the invention, have longitudinal grooves.

The instant invention sets forth novel press rolls 48 and 50, as shown in FIG. 3 in use in a twin roll press 52, in which the rolls 48 and 50 are journalled in their housing 54 for down-turning operation. Here too, inlet boxes 56 are disposed at opposite sides of the press 52, and cleaning shower heads 58 are likewise provided. Again, roll 50 is shown only as a line drawn circle, but it is to be understood that it is identical to roll 48.

Figure 4:
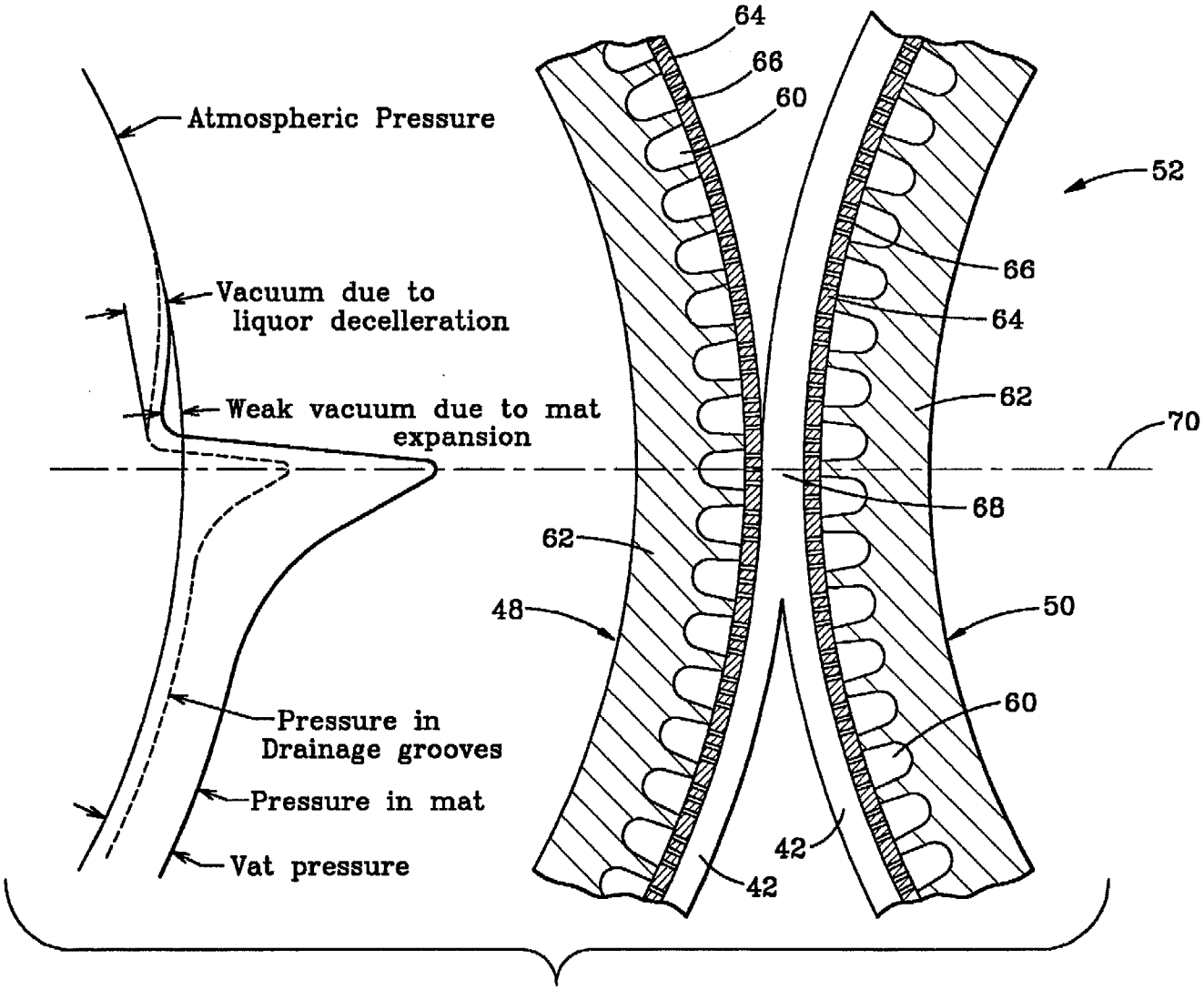
FIG. 4 is a fragmentary cross-sectional view of the coacting press rolls, of FIG. 3, shown in association with a pressure diagram.

Rolls 48 and 50 have longitudinal drainage grooves 60. No drainage holes are drilled through the drums 62 of the rolls 48 and 50. The drums 62 are imperforate; filtrate is not allowed free entry into the drums 62. Too, the grooves 60 are completely sealed off from each other. The drums 62 are enclosed by cylindrical sheaths 64 which have a multiplicity of filtering holes 66 formed therein. Each of the cylindrical sheaths 64 is substantially concentric with the corresponding one of the drums 62. As shown, in greater detail in FIG. 4, each of the holes 66 extends completely through the corresponding sheath 64 so that holes 66 open onto the grooves 60 and externally of the sheaths 64.

Twin roll press 52, by employment of the novel press rolls 48 and 50, is capable of developing very high pressures in the nip 68. The pressure diagram incorporated in FIG. 4 aligns with the fragmentary portions of the rolls 48 and 50, the nip centerline 70 giving a reference. As noted thereon, the diagram denotes atmospheric pressure, vacuum pressures, and elevated pressures occurring as the rolls 48 and 50 up-turn. The press 52 provides high hydraulic pressures in the grooves 60, resulting in high accelerations and velocities of the longitudinal drainage flow. This offers excellent filtrate removal. After each groove 60 leaves the nip area, the aforesaid velocity not only prevents rewetting of the mat 42, it creates a high vacuum which further dewaters the mat after the nip.

Figure 5:
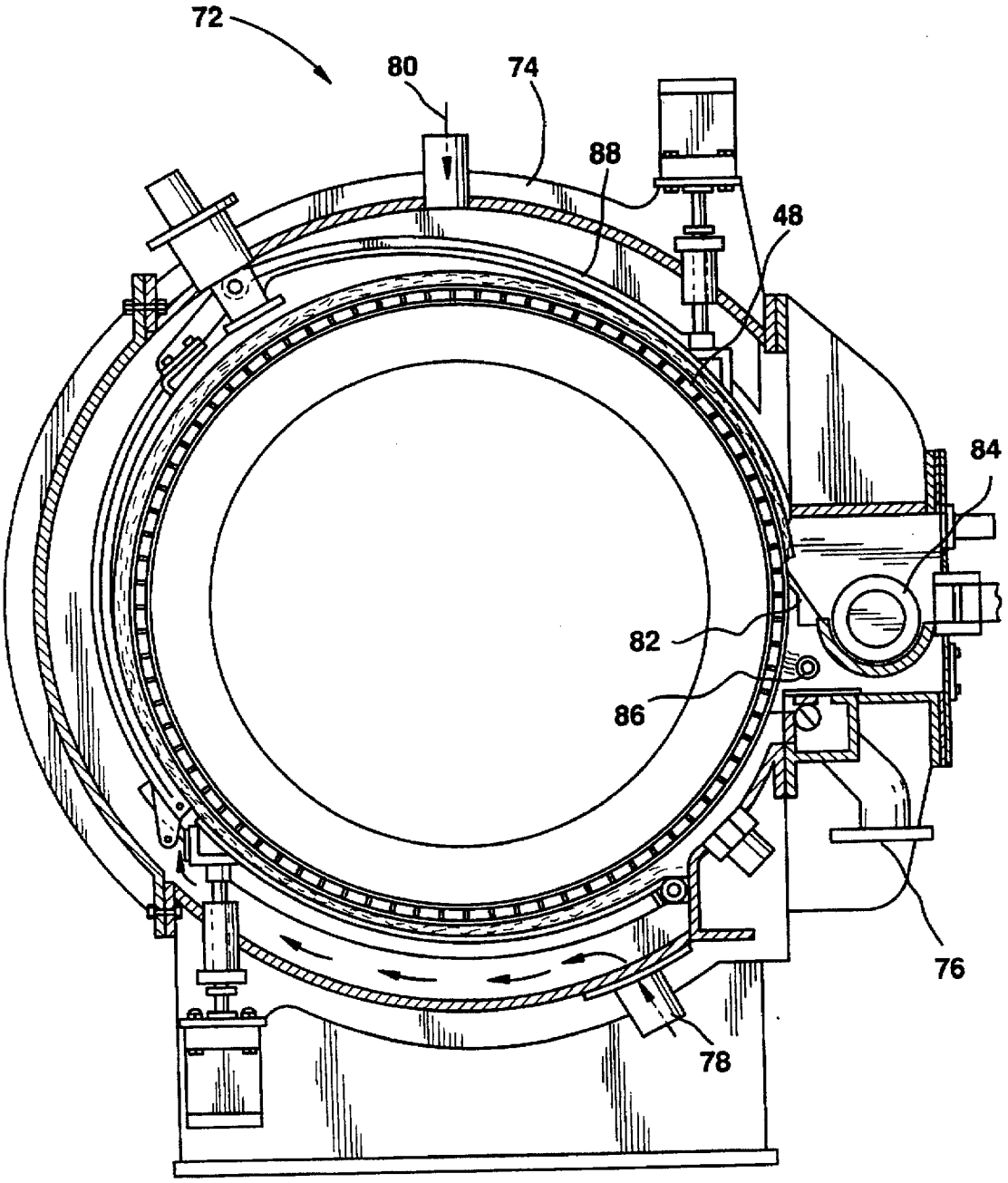
FIG. 5 is a cross-sectional depiction of a single roll press which incorporates the longitudinally grooved press roll.

FIG. 5 illustrates a single roll press 72 which incorporates therein the improved press roll 48. The roll 48 is journalled in the housing 74 and the latter has a pulp slurry inlet 76. Wash liquor inlets 78 and 80 are arranged at the top and bottom of the housing 74. The doctor 82 is positioned just in alignment with the conveyor 84. Immediately below the doctor 82 is a cleaning shower head 86. Here, in lieu of a coacting roll, the press 72 employs a compaction baffle 88.

Figure 6:
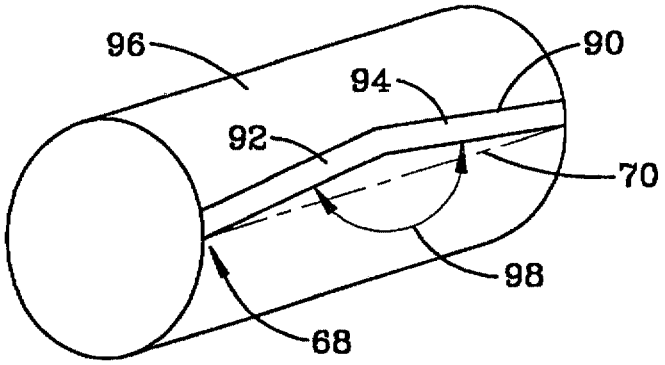
FIG. 6 is a simple line drawing, in perspective, illustrative of the herringbone configuration of the grooves in the novel press roll, according to an embodiment of the invention.

The longitudinal grooves 60 are represented to be straight and parallel with the rotary axis of the rolls 48 and 50, or substantially so. However, in an alternate embodiment of the invention, the drainage grooves can be of a herringbone pattern, as this would be beneficial. Such an arrangement is represented, in FIG. 6, byway of simple line illustration in perspective, with only one of the grooves 90 being shown for example. The herringbone pattern must be backswept in the direction of rotation. Groove 90 comprises a pair of linear troughs 92 and 94 which conjoin, contiguously, substantially midway along the roll 96. It can be appreciated that pressure will build up from the center outwardly, as the troughs 92 and 94 define an obtuse angle 98 therebetween. It has been determined that the sweep back distance should not be more than about one-half inch to one inch.

Figure 7:
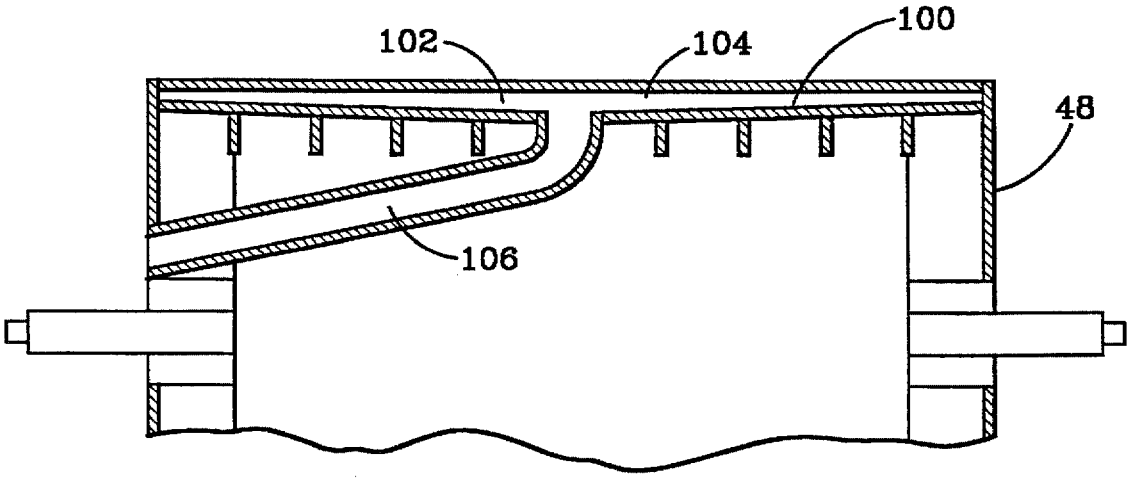
FIG. 7 is a partial cross-sectional view, taken along the axis thereof, of a press roll, according to an embodiment of the invention showing the tapering of the longitudinal grooves, and the center drainage therefor.

In rolls 48 and 50, the grooves 60 drain filtrate out the axial ends thereof, and the same is the case with grooves 90 of herringbone pattern. However, the invention comprehends a center discharge of the longitudinal grooves, and this is illustrated in FIG. 7 with only a fragmentary portion of a roll 48 being shown with but one longitudinal groove 100. Groove 100 comprises a pair of linear troughs 102 and 104 which conjoin, contiguously, at a point midway along the length of the roll 48. Too, the troughs 102 and 104 are formed of increasing depth, Progressively, toward the aforesaid midway point of conjoining. At the aforesaid point, the troughs 102 and 104 communicate with a conduit 106 which carries the filtrate therethrough for discharge in adjacency to the rotary axis of the roll 48.

While I have described my invention in connection with specific embodiments thereof it is to be clearly understood that this is done only by way of example, and not as a limitation to the scope of the invention as set forth in the cited purposes of the invention, and in the appended claims.

I claim:

1. A twin roll, slurry-handling press, comprising:

a housing; and a pair of coacting press rolls journalled in said housing; wherein said housing has means for admitting pulp slurry to said press rolls; and further including doctor means for extracting a pulp mat from said rolls; and wherein each of said rolls comprises a drum having a longitudinal axis, an outer periphery, and a multiplicity of longitudinally extending grooves formed therein about said periphery; and each of said rolls further comprises a cylindrical sheath which encloses said drum therewithin, wherein said cylindrical sheath seals off each one of said grooves from the other of said grooves thereof.

2. A twin roll, slurry-handling press according to claim 1, wherein:

each of said drums is imperforate.

3. A twin roll, slurry-handling press, according to claim 1, wherein:

said grooves, in each of said rolls, define a herringbone configuration in which each of said grooves comprises a pair of linear troughs which conjoin, contiguously, substantially midway along said axis, and said troughs define an obtuse angle therebetween.

4. A twin roll, slurry-handling press according to claim 1, wherein:

said sheath has a multiplicity of minute holes formed therein, wherein each of said holes extends completely through said sheath so that said holes open onto of said holes extends completely through said sheath so that said holes open onto said grooves and externally of said sheath, said holes being effective for filtering liquid therethrough.

5. A single roll, slurry-handling press, comprising:

a housing;

a press roll journalled in said housing, wherein said housing has means for admitting pulp slurry to said roll, and doctor means for extracting a pulp mat from said roll; and means for compacting the pulp mat on said roll circumjacent said roll; and wherein said roll comprises an imperforate drum having a longitudinal axis, an outer periphery, and a multiplicity of longitudinally extending grooves formed therein about said periphery, and wherein said roll further comprises means overlying said grooves for filtering liquid therethrough;

said filtering means comprises a cylindrical sheath which is substantially concentric with said imperforate drum and which encloses said imperforate drum therewithin;

said sheath comprises means for sealing off each one of said grooves from the other of said grooves thereof.

6. A single roll, slurry-handling press, according to claim 5, wherein:

said compacting means comprises a compaction baffle.

7. A single roll, slurry-handling press, according to claim 5, wherein:

said sheath has a multiplicity of minute holes formed therein, wherein each of said holes extends completely through said sheath so that said holes open onto said grooves, and externally of said sheath.

8. The twin roll, slurry-handling press according to claim 1, wherein:

said grooves extend longitudinally between opposite, axially facing ends of a corresponding one of said rolls.

9. The twin roll, slurry-handling press according to claim 8, wherein:

said longitudinally extending grooves are effective for draining filtrate out of said axially facing ends.

10. The single roll, slurry-handling press according to claim 5, wherein:

said grooves extend longitudinally between opposite, axially facing ends of said roll.

11. The single roll, slurry-handling press according to claim 10, wherein:

said longitudinally extending grooves are effective for draining filtrate out of said axially facing ends.

* * * * *